United States Patent [19]

Fuller

[11] 4,310,319

[45] Jan. 12, 1982

[54] STEERABLE PROPELLER

[76] Inventor: John J. Fuller, 32 Hawley Rd., Scituate, Mass. 02066

[21] Appl. No.: 224,101

[22] Filed: Jan. 12, 1981

Related U.S. Application Data

[63] Continuation of Ser. No. 31,852, Apr. 20, 1979, abandoned.

[51] Int. Cl.[3] ..... B63H 1/04

[52] U.S. Cl. ..... 440/51; 440/53; 114/166

[58] Field of Search ..... 114/144 R, 162, 165, 114/166; 440/51, 53, 58

[56] References Cited

U.S. PATENT DOCUMENTS 571,127 11/1896 Mosley .
711,884 10/1902 Sjostrom .
2,398,033 4/1946 Myers .
2,446,229 8/1948 House .
2,800,150 7/1957 Farwell, Sr. .
3,327,675 6/1967 Humphreys .
3,339,517 9/1967 Bergstedt .
4,077,352 3/1978 Liaaen .

FOREIGN PATENT DOCUMENTS 630734 11/1961 Canada .

*Primary Examiner*—Trygve M. Blix
*Assistant Examiner*—Stephen P. Avila

[57] ABSTRACT

A propeller that can be steered to the left or the right of the center line of a boat's keel in order to increase the steerability of a boat or craft driven by a conventional straight line drive inboard mounted engine.

1 Claim, 8 Drawing Figures

STEERABLE PROPELLER

This a continuation of Ser. No. 31,852 filed 4/20/79, abandoned.

BACKGROUND OF THE INVENTION

The present invention relates to the steerability of a boat or craft propelled by a conventional straight line drive inboard mounted engine, which also includes "V" drive engines mounted to a straight line drive propeller shaft.

Outboard engines or "L" drive and stern power outdrive or "Z" drive have great steering advantages over conventional inboard straight line drive powered boats or crafts due to the fact that propellers of such "L" or "Z" drives can be steered in an arc about the center line of a keel of a boat thus providing an angular thrust to the stern of a boat. This thrust pushes the stern around without the necessity of propelling the boat a great distance forward as compared to the distance and area that would be required for a straight line drive propelled boat to accomplish the same turning maneuver.

Through the years this problem has become greater because every year more boats are on the waterways and harbors and marinas are becoming more crowded with less area for boats to maneuver. Bow thrusters have come in to use in some instances primarily for that reason.

SUMMARY OF THE INVENTION

It is the object of the invention, by use of gears mounted externally of the hull of a boat or craft, to provide for the pivoting of the propeller in an arc to the left or right of the center line of the keel of a boat thus allowing for a thrust at an angle to the center line of the keel.

It is another object of the invention to pivot a tubular rudder as a unit with the propeller which will protect the propeller from damage while at the same time increasing propeller efficiency.

It is another option of the invention to pivot a blade type of rudder as a unit with the propeller.

DETAIL DESCRIPTION OF THE DRAWINGS

Figure 1:
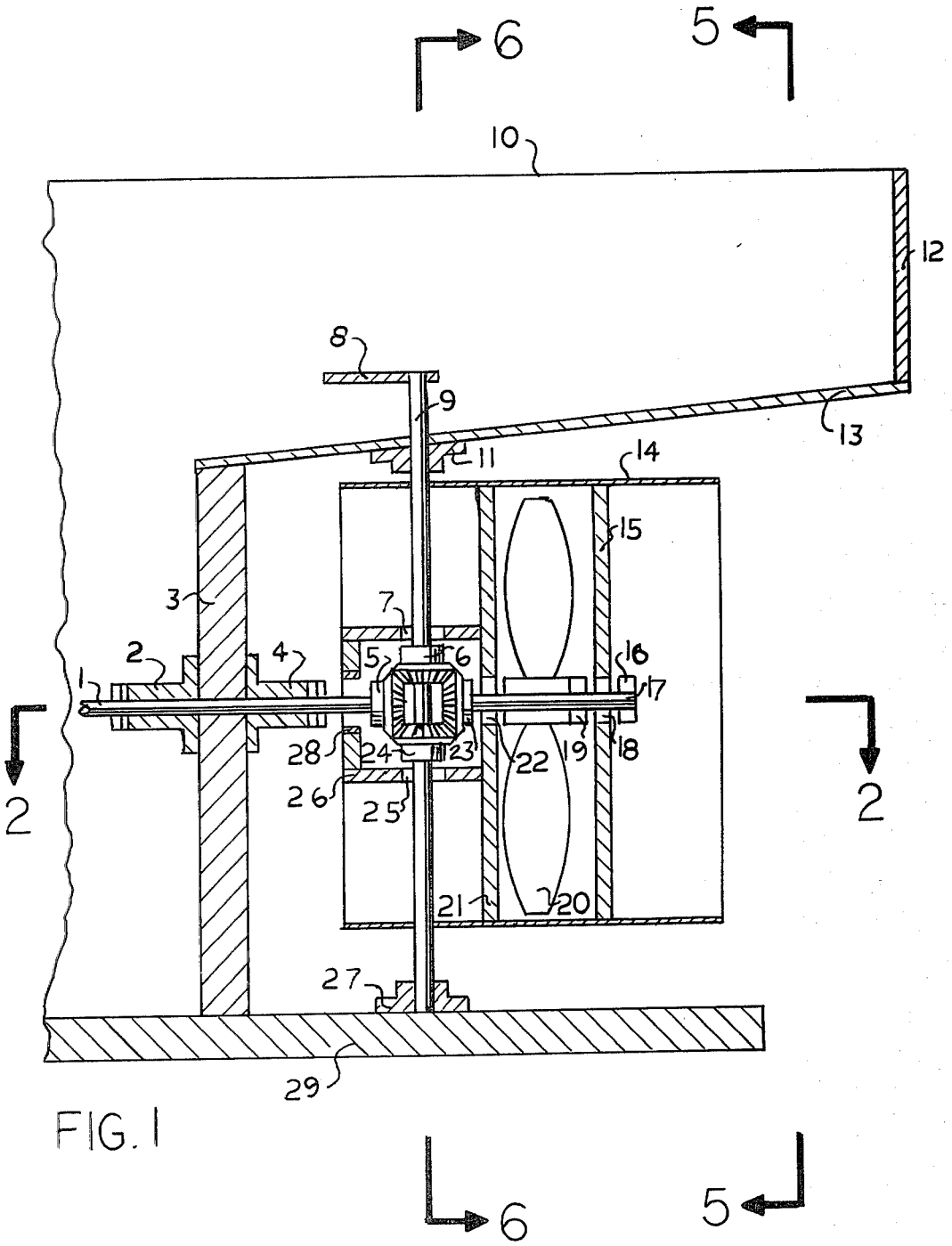
FIG. 1 is a cross-section of the present invention shown installed with a tubular rudder to the stern of a boat.

Referring now to the drawings and more particularly to FIG. 1, the engine propeller shaft 1 from engine passes through stuffing box 2 and through stern post 3 and through stern bearing 4. A bevel gear 5 is firmly attached to engine propeller shaft 1. Bevel gears 6 and 24 are free to rotate on rudder shaft 9. Bevel gears 6 and 24 are also in mesh with bevel output gear 23. Bevel output gear 23 is secured to output shaft 17. A propeller 20 is secured to output shaft 17. A propeller nut 19 is shown against the hub section of propeller 20. A shaft collar 16 is shown on the end of output shaft 17. Output shaft 17 is free to rotate through bearings 22 and 18. When engine propeller shaft 1 is rotated, output shaft 17 and propeller 20 must rotate in the opposite direction.

Bearing brace 15 retains bearing 18, while the ends of bearing brace 15 are fastened to tubular rudder 14. Bearing brace 21 retains bearing 22, while the ends of bearing brace 21 are fastened to tubular rudder 14. Bearing brace 21 also serves as a support for gear cage 26. Gear cage 26 retains thrust bearings 25 and 7. Thrust bearings 25 and 7 are intended to be bearing surfaces for end thrust of bevel idlers gears 6 and 24. Rudder shaft 9 is firmly secured to circular rudder 14. Rudder shaft 9 is supported by rudder shaft bearing 27 which is fastened to keel 29. The upper end of rudder shaft 9 passes through rudder shaft bearing 11 which is fastened to under side of stern 13. A rudder steering linkage 8 is fastened to upper end of rudder shaft 9. Steering movement of rudder steering linkage 8 will cause rudder shaft 9 and tubular rudder 14 to steer as a unit to the left or right of the center line of keel 29.

Figure 2:
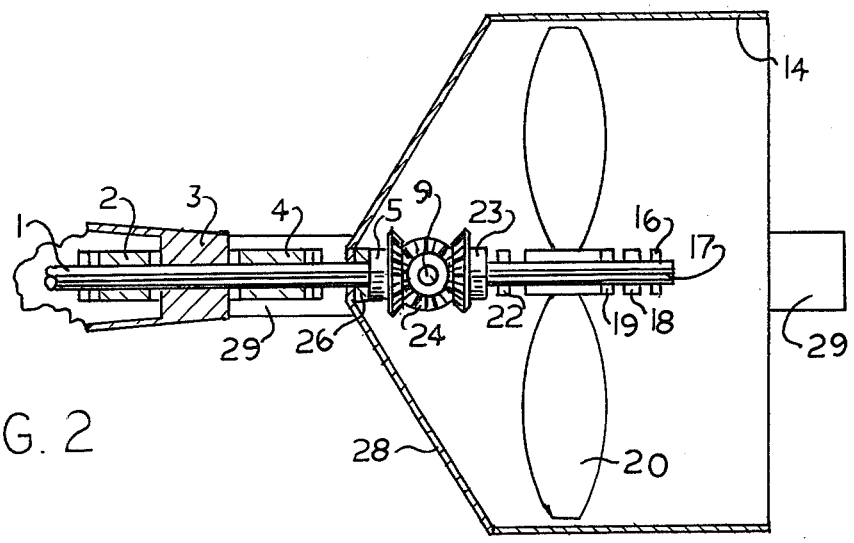
FIG. 2 is a cross-section taken on the line 2—2 of FIG. 1.

FIG. 2 shows a top section view of the steerable propeller device aligned with the center line of keel 29. This position would be for straight forward or straight reverse motion of the boat or craft.

Figure 3:
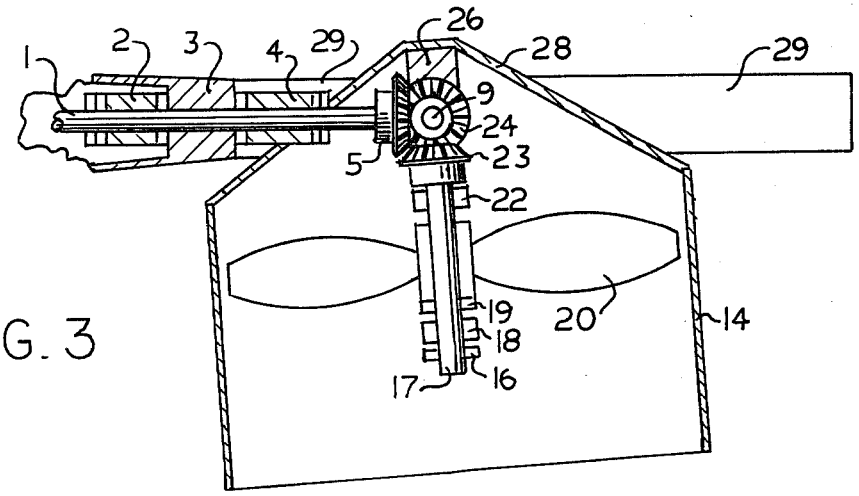
FIG. 3 is a cross-section taken on the line 2—2 of FIG. 1 with the present invention located in a clockwise position.

FIG. 3 shows a top section view of the steerable propeller device steered in a clockwise direction at an angle of approximately 85 degrees to the left of the center line of keel 29. Output gear 23 has been allowed to "walk around" idler gear 24 and also "walk around" idler gear 6 not shown. The limiting factor to the maximum number of degrees of arc that the present invention can be steered is to a position just before interference of drive gear 5 with output gear 23. The smaller the diameters of drive gear 5 and output gear 23, the greater the possible arc of steerage of the device and conversely the greater the diameters of drive gear 5 and output gear 23, the lesser the possible arc of steerage of the device.

Figure 4:
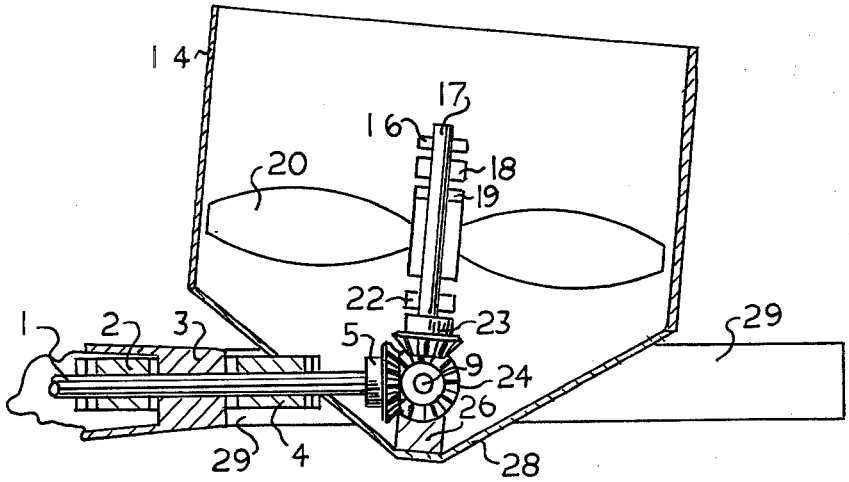
FIG. 4 is a cross-section taken on the line 2—2 of FIG. 1 with the present invention located in a counter-clockwise position.

FIG. 4 shows a top section view of the steerable propeller device steered in a counter-clockwise direction at an angle of approximately 85 degrees to the right of the center line of keel 29. Again output gear 23 has been allowed to "walk around" idler gear 24 and also "walk around" idler gear 6 not shown.

Figure 5:
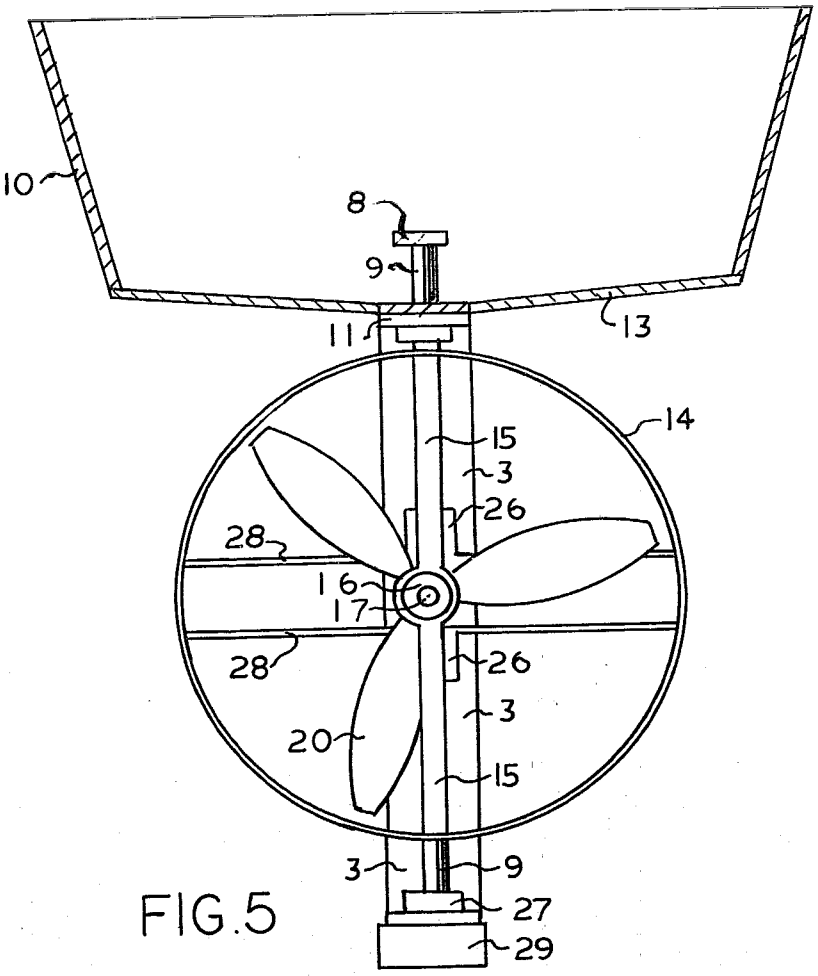
FIG. 5 is a plan view taken on the line 5—5 of FIG. 1.

FIG. 5 shows a section view from the stern end of a boat or craft. Transom 12 is not shown. The device is aligned with the keel 29 for straight forward or straight reverse motion of the boat.

Bearing brace 15 is shown to be vertically fastened to circular rudder 14. Directly forward and aligned with bearing brace 15 is bearing brace 21 which is also vertically fastened to tubular rudder 14.

Figure 6:
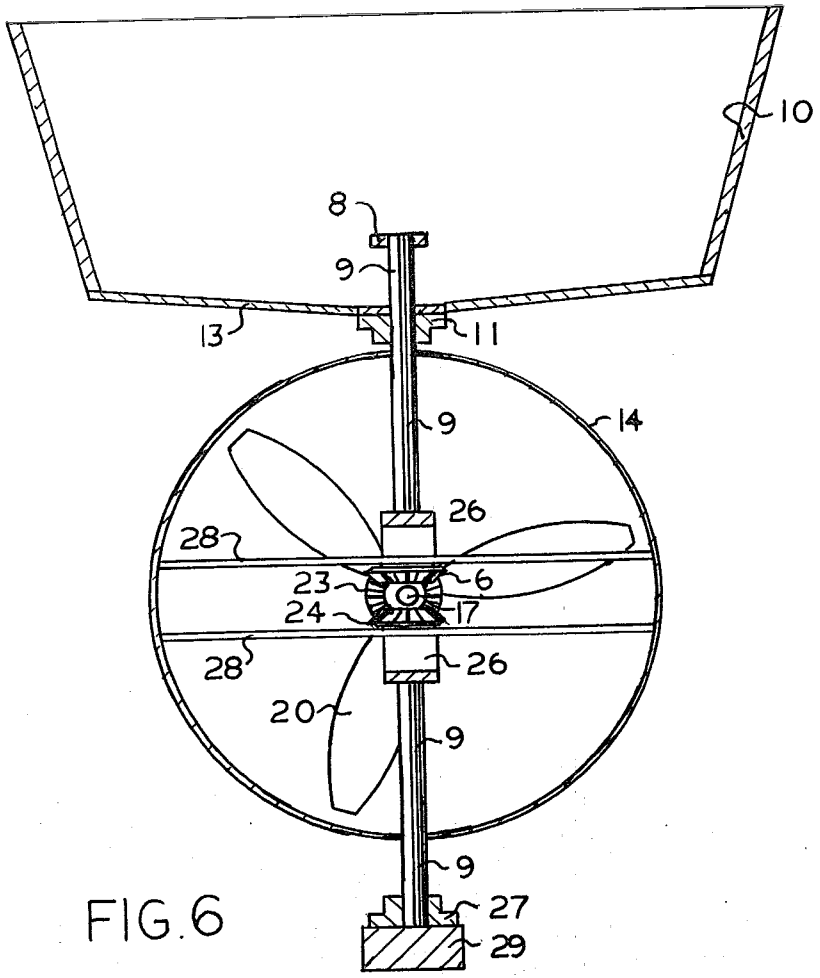
FIG. 6 is a cross-section taken on the line 6—6 of FIG. 1.

FIG. 6 shows a section view of the device. Drive gear 5 is not shown. Transverse braces 28 are fastened to circular rudder 14 at each end of the braces. The central portion of transverse braces 28 are fastened to gear cage 26.

Figure 7:
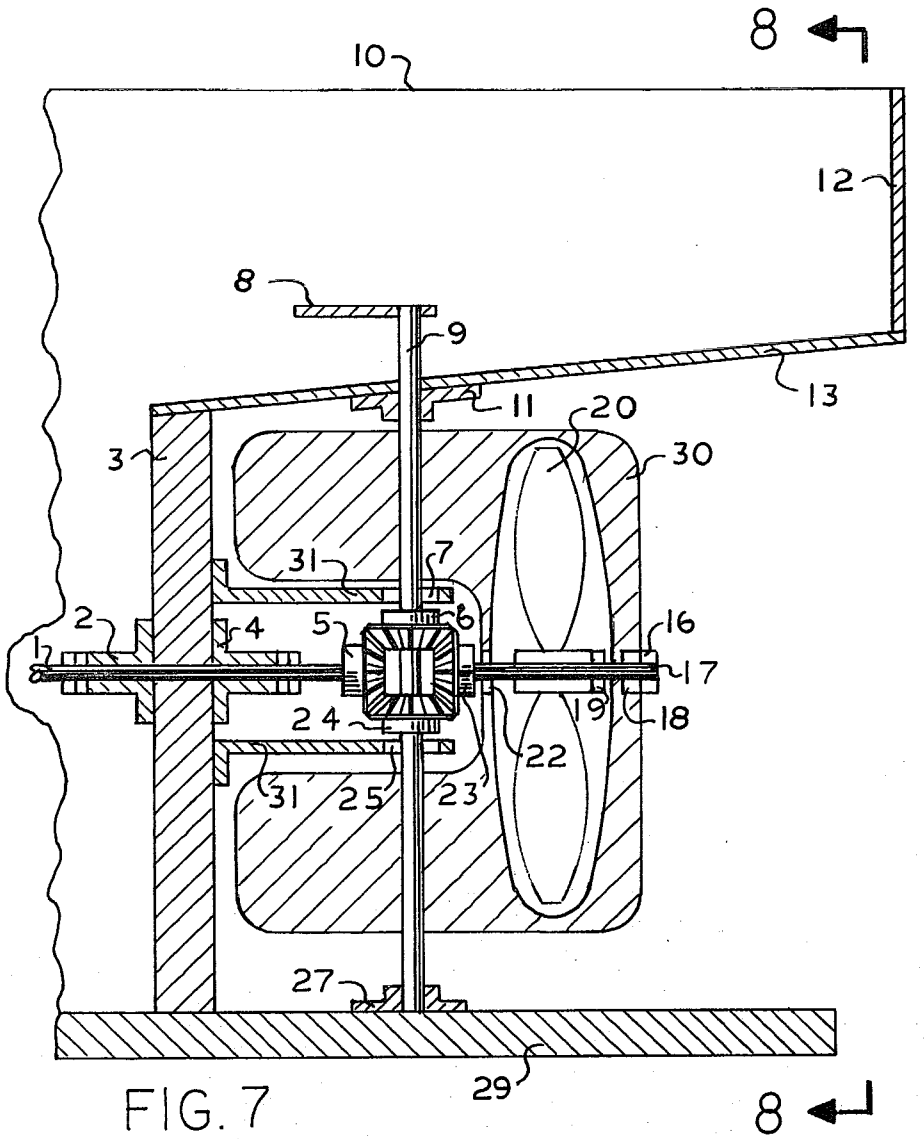
FIG. 7 is a cross-section of the present invention shown with a blade type rudder installed to the stern of a boat.

FIG. 7 shows a section view of the device with a blade type rudder 30 installed. Blade type rudder 30 is shown instead of tubular rudder 14 as is shown in FIGS. 1–2–3–4–5–6. Blade type rudder 30 is fastened to rudder shaft 9. When rudder steering linkage 8 is steered, rudder shaft 9 and blade type rudder 30 are also steered. Stern post gear braces 31 are fastened to stern post 3. Stern post gear braces 31 retain thrust bearing 7 and thrust bearing 25. Thrust bearing 7 and thrust bearing 25 allow rudder shaft 9 to rotate through stern post gear braces 31. An opening through blade type rudder 30 allows for rotation of propeller 20 while at the same time blade type rudder 30 acts as a mounting support for bearings 22 and 18. Bearings 22 and 18 provide rotational and thrust bearing surfaces for output shaft 17.

Figure 8:
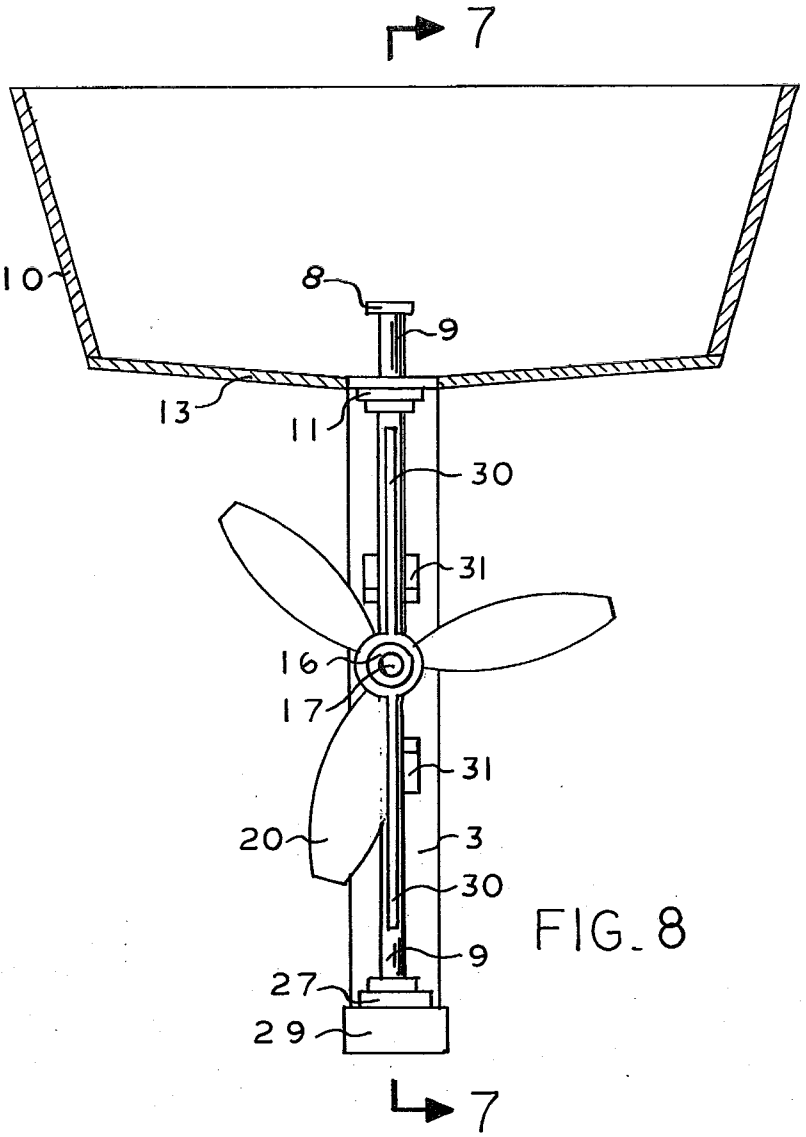
FIG. 8 is a plan view taken on the line 8—8 of FIG. 7.

FIG. 8 is a plan view taken on the line 8—8 of FIG. 7. In FIG. 8 blade type rudder 30 is aligned with rudder shaft 9. Bevel gears are not shown.

What is claimed is:

1. Steerable propulsion means for a marine vessel including a substantially vertical pivotal rudder shaft whose axis materially intersects the common substantially horizontal plane of an engine propeller shaft with beveled drive gear, and of an output shaft with beveled driven gear and propeller assembly; said vertical pivotal rudder shaft providing bearing support surfaces for a matched pair of beveled idler gears; said beveled idler gears meshed with said beveled drive gear of said engine propeller shaft and said beveled driven gear of said output shaft with propeller assembly; said beveled idler gears equidistantly spaced and diametrically opposed about center line of said common horizontal plane of said engine propeller shaft and said output shaft with propeller assembly; said beveled idler gears providing transmission means of divided engine power torque from said beveled drive gear of said engine propeller shaft to said driven beveled gear of said output shaft with propeller assembly.

* * * * *